US008742332B2

(12) United States Patent
Horikoshi et al.

(10) Patent No.: US 8,742,332 B2
(45) Date of Patent: Jun. 3, 2014

(54) MASS SPECTROMETER AND MASS SPECTROMETRY METHOD

(75) Inventors: Kazuhiko Horikoshi, Yokohama (JP); Naotoshi Akamatsu, Fujisawa (JP)

(73) Assignee: Hitachi, Ltd., Tokyo (JP)

( * ) Notice: Subject to any disclaimer, the term of this patent is extended or adjusted under 35 U.S.C. 154(b) by 214 days.

(21) Appl. No.: 12/952,453

(22) Filed: Nov. 23, 2010

(65) Prior Publication Data

US 2011/0127420 A1 Jun. 2, 2011

(30) Foreign Application Priority Data

Nov. 27, 2009 (JP) ..... 2009-269422

(51) Int. Cl.
*H01J 49/00* (2006.01)

(52) U.S. Cl.
USPC ..... 250/282; 250/281; 250/288

(58) Field of Classification Search
CPC ..... H01J 49/00; B01D 59/44
USPC ..... 250/282
See application file for complete search history.

(56) References Cited

U.S. PATENT DOCUMENTS

| | | | | |
|---|---|---|---|---|
| 6,895,804 | B2 * | 5/2005 | Lovell et al. | 73/31.05 |
| 7,041,971 | B2 * | 5/2006 | Fukano et al. | 250/288 |
| 7,772,568 | B2 * | 8/2010 | Horikoshi et al. | 250/443.1 |
| 7,928,370 | B2 * | 4/2011 | Amirav et al. | 250/288 |
| 2007/0210696 | A1 | 9/2007 | Ozawa et al. | |
| 2009/0072135 | A1 | 3/2009 | Horikoshi et al. | |

FOREIGN PATENT DOCUMENTS

| | | |
|---|---|---|
| JP | 9-68509 | 3/1997 |
| JP | 09-320512 | 12/1997 |
| JP | 2000-292319 | 10/2000 |
| JP | 2008-003016 | 1/2008 |
| JP | 2008-304340 | 12/2008 |
| JP | 2010-145142 | 7/2010 |

OTHER PUBLICATIONS

Office Action issued in Japanese Patent Application No. 2009-269422 on Feb. 26, 2013.

* cited by examiner

*Primary Examiner* — Phillip A Johnston
(74) *Attorney, Agent, or Firm* — Antonelli, Terry, Stout & Kraus, LLP.

(57) ABSTRACT

A mass spectrometer and a mass spectrometry method adapted for mass spectrometry of a hardly volatile minuscule organic foreign matter of several μm often causing a device defect are disclosed. A sample gasified by a sample heating probe is introduced into an ion source, and the sample thus ionized is detected by being separated in accordance with the mass-to-charge ratio. In this mass spectrometry technique, the sample heating probe is covered with a cylindrical gas guide mechanism, and the gasified sample is led efficiently to the ion source by the gas guide mechanism, thereby making possible the contribution by the sample components which otherwise might be dispersed and wasted in the prior art. As a result, the mass spectrometry with higher sensitivity and S/N than in the prior art is realized.

11 Claims, 5 Drawing Sheets

MASS SPECTROMETER AND MASS SPECTROMETRY METHOD

INCORPORATION BY REFERENCE

The present application claims priority from Japanese application JP 2009-269422 filed on Nov. 27, 2009, the content of which is hereby incorporated by reference into this application.

FIELD OF THE INVENTION

This invention relates to a mass spectrometry technique for analyzing a minuscule amount of a minuscule sample with high S/N and high sensitivity.

BACKGROUND OF THE INVENTION

The minuscule foreign matter of about several μm generated in the process to manufacture a precision electronic device is a great problem which causes a defect of the resulting product. Especially in the manufacturing process of a liquid crystal display using a great amount of organic materials, the minuscule foreign matter of a high-polymer organic material sometimes causes the yield reduction. The minuscule organic foreign matter is normally analyzed/identified using the spectrometry method such as the microscopic Raman spectrometry or the microscopic FT-IR. The use of these spectrometry methods makes it possible to obtain a great amount of information on the molecular structure of an organic material and provides a very useful tool to identify an unknown organic material. Nevertheless, the FT-IR method, which uses the infrared light and has the spatial resolution as large as about 10 μm, is inapplicable to the minuscule foreign matter of several μm in many cases. Also, the high-polymer organic foreign matter having the thermal history of not lower than 200° C. in the manufacturing process often emits the fluorescent light by laser radiation and cannot be identified even by the microscopic Raman spectrometry. In such a case, the mass spectrometry is effective to identify an unknown organic compound. According to the mass spectrometry, the sample is required to be ionized by gasification, and such a hardly volatile sample as a high-polymer organic material is normally required to be decomposed thermally by rapid heating. The thermal decomposition produces the mass spectrum of the fragment ions generated from the original molecules and the unknown sample can thus be identified.

In the case where the direct introduction probe of the commercially available gas chromatographic mass spectrometer is used, a minuscule sample is normally inserted in a quartz glass container of Φ1 mm and about several mm deep. The quartz glass container with the minuscule foreign matter therein is heated by a heater, so that the sample is thermally decomposed and gasified for spectrometry. Also, the sample of the minuscule foreign matter is required to be set in a special sample container or the like when introduced into a thermal decomposer arranged in the stage before the capillary column of the gas chromatograph. In the case where the Curie point pylorizer is used as a thermal decomposer, for example, the sample is wrapped in a thin piece (pyrofoil) of a ferromagnetic material of about several mm square. This sample, impressed with a high frequency, is thermally decomposed and gasified instantaneously by being heated to the Curie point of the pyrofoil. A device is also available which has such a mechanism that the sample is set in a Pt container and quickly heated by being dropped in a heated furnace. Further, JP-A-9-320512 and JP-A-2008-003016 disclose a method in which a sample holder is configured of a filament and electrically energized to heat and gasify the sample. According to the method described in JP-A-2008-304340, on the other hand, the sample is thermally heated and gasified by radiating a laser light on a metal probe. Especially, the methods of JP-A-2008-003016 and JP-A-2008-304340 are used only for spectrometry of a minuscule organic foreign matter by improving the local heatability.

SUMMARY OF THE INVENTION

For the pyrolytic mass spectrometry of a very small amount of a minuscule sample with high S/N (the detection system being operated under the same condition), it is important (1) not to ionize the contaminant components other than the sample as far as possible, and (2) to ionize the gasified sample components as much as possible.

According to JP-A-9-320512 and JP-A-2008-003016 described above, a measure is taken to heat and gasify only the sample by improving the locality of the heating area in order to suppress the gasification of the contaminant components as described in (1). No effort is made, however to ionize the gasified sample components as much as possible. The sample heated and gasified by the sample heating probe fly isotropically in the form of molecules or fragments. The area where the sample is ionized, on the other hand, is a very limited area normally called an ion source. Naturally, only the molecules that have entered the ion source can contribute to the spectrometry. In the actual spectrometry, however, only a part of the flying sample molecules can reach the ion source. The sample molecules discharged by pump or adsorbed onto the wall surface of the chamber are lost without contributing to the spectrometry. Especially in the spectrometry of a very small amount of the sample, how the sample is introduced efficiently into the ion source is the key for a successful spectrometry.

In order to introduce the gasified sample into the ion source as much as possible, it is expedient most of all to reduce the distance between the sample and the ion source. An ordinary ion source such as the ion source of electron impact type, however, has a filament for emitting thermal electrons which increases the ion source to a considerably high temperature. The sample, when brought near this ion source, is heated to a high temperature by heat radiation from the ion source, and therefore, some distance is required to be kept between the sample and the ion source. Specifically, the problem in the mass spectrometry of a very small amount of a minuscule sample is how to introduce as much a part of the minuscule sample as possible into the ion source within a short period of time while at the same time suppressing the gasification of the contaminant components other than the sample.

In order to solve the problem described above, according to this invention, a mechanism is conceived by which a spectrometry sample heated and gasified is introduced efficiently into the ion source. For the purpose of flying the sample isotropically by heating so that the components conventionally failing to be introduced to the ion source may be introduced to the ion source, the sample heater is covered with a cylinder and one end of the cylinder is directed toward the inlet of the ion source to lead the gasified sample efficiently to the ion source. The wall surface of the cylinder can be heated in order that the molecules having a large adsorption energy which may be adsorbed to the cylinder when the gasified sample bombards the cylinder can be desorbed from the cylinder again. Once the spectrometry probe on which the sample is mounted is heated by the cylindrical heating mechanism, the contaminant components such as hydrocarbon adsorbed on the sample would be gasified and hamper the spectrometry. For this reason, a structure is employed with the temperature set in such a manner that the spectrometry probe with the sample mounted thereon is not heated as far as possible by the cylindrical heating mechanism. As a result, the intended sample can be introduced to the ion source in a greater amount than in the prior art while at the same time eliminating the effect of the contaminant components, and therefore, a very small amount of a minuscule sample can be analyzed with a high sensitivity and S/N.

According to this invention, there is provided a mass spectrometry method of direct introduction type with a high S/N for a minuscule sample of several p.m.

Other objects, features and advantages of the invention will become apparent from the following description of the embodiments of the invention taken in conjunction with the accompanying drawings.

DESCRIPTION OF THE INVENTION

Embodiment 1

Figure 1:
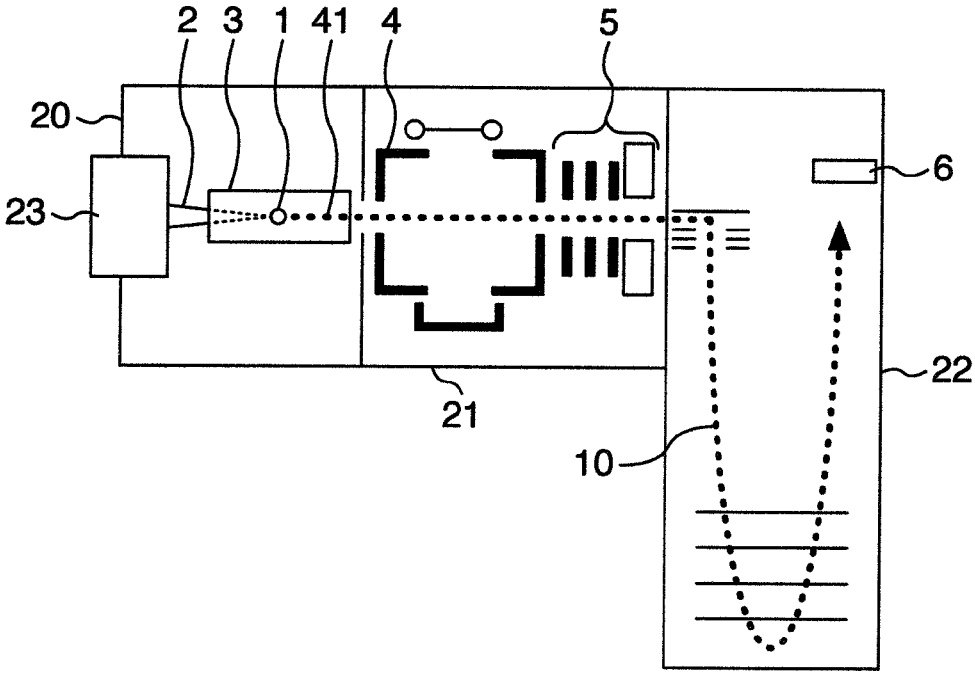
FIG. 1 is a diagram for explaining the configuration of the mass spectrometer according to an embodiment of the invention.

The first embodiment is explained below with reference to FIG. 1. A cylindrical guide mechanism 3 is arranged in a sample entrance chamber 20 in such a manner as to cover a sample heating probe 2 with a spectrometry sample 1 mounted thereon. A chamber 21 of an ion optical system is arranged adjacently to the sample entrance chamber 20. An ion source 4 is arranged on the sample entrance chamber 20 side in the ion optical system chamber 21, and an ion transport optical system 5 on the other side of the ion source 4 far from the sample entrance chamber 20. Further, a mass spectrometry unit 22 is arranged adjacently to the ion optical system chamber 21 on the other side of the ion source 4 far from the sample entrance chamber 20. The cylindrical guide mechanism 3 has an opening to send the gasified sample in the direction toward the ion source 4 as viewed from the sample heating probe 2. The sample heating probe 2 is held by a heating probe holding mechanism 23.

The mass spectrometry process of the sample is explained below. First, the spectrometry sample 1 is heated and gasified by the sample heating probe 2. The sample thus gasified enters the ion source 4 from the sample inlet 41 of the ion source 4 and is ionized. The sample thus ionized is led to the mass spectrometry unit 22 through an ion transport optical system 5. In the mass spectrometry unit 22, the sample is separated into parts in accordance with the mass-to-charge ratio (hereinafter expressed as m/z) of the sample ions and reaches a detector 6 where they are subjected to mass spectrometry. This flow of the sample is indicated by dotted arrow 10. Though not shown, a load lock chamber is desirably arranged independently of the sample entrance chamber 20 to permit the sample to be replaced quickly. In replacing the sample, only the load lock chamber is opened to the atmosphere, and after setting the sample, the load lock chamber is vacuumized by roughing. In this way, the time required to replace the sample can be shortened. Also, though not directly related to the invention, each chamber is exhausted in vacuum by a vacuum exhaust system not shown.

Figure 2:
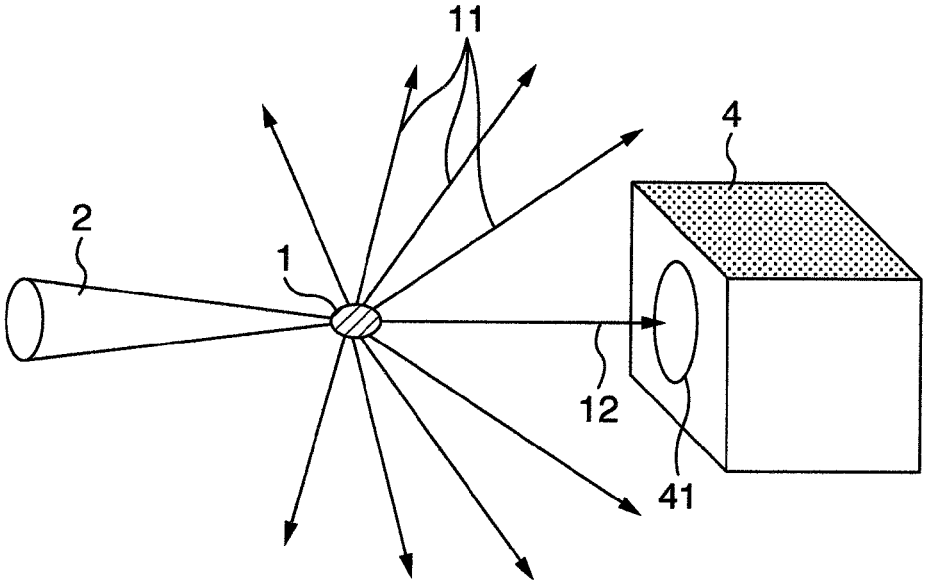
FIG.2 PRIOR ART
FIG. 2 is a diagram for explaining the relation between a sample and an ion source according to the conventional method.

The cylindrical guide mechanism 3 providing the feature of the invention is explained. FIG. 2 is a diagram for explaining the conventional method not using the cylindrical guide mechanism. The spectrometry sample 1 heated by the sample heating probe 2 flies isotropically at the time of being gasified. In FIG. 2, the sample parts flying isotropically are designated as a pattern by arrows 11 and 12. Of these sample parts of the gasified sample, only the part 12 entering the sample inlet 41 contributes to the spectrometry. The parts 11 of the gasified sample which have failed to enter the sample inlet 41 directly are adsorbed to the wall surface (not shown) of the chamber or enter the exhaust system (not shown) wastefully. Although some components adsorbed on the chamber wall surface are desorbed and enter the sample inlet 41 of the ion source, most of them are wasted without contributing to the spectrometry.

Figure 3:
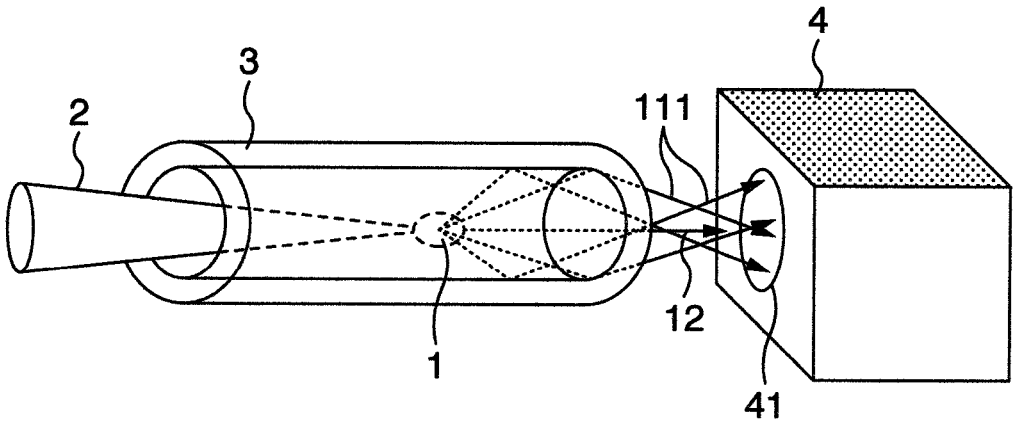
FIG. 3 is a diagram for explaining a cylindrical guide mechanism according to an embodiment of the invention.

Among the sample parts 11 and 12 flying isotropically in gas form, the parts 11 having failed to enter the sample inlet 41 of the ion source 4 directly are led to the same inlet 41 by the cylindrical guide mechanism 3 according to the invention. FIG. 3 shows a structure in which the cylindrical guide mechanism 3 according to the invention covers the sample heating probe. Among the components flying and failing to enter the sample inlet 41 directly, those components 111 impinged and adsorbed on the inner wall of the cylindrical guide mechanism 3 which, after being desorbed, enter the sample inlet 41 through the opening of the cylindrical guide mechanism 3 formed in the direction toward the ion source 4, contribute to the spectrometry. As compared with the conventional mass spectrometry, therefore, the sensitivity is increased advantageously. Also, in order that the components adsorbed on the inner wall of the cylinder are led efficiently to the sample inlet 41, one open end of the cylinder is directed toward the sample inlet 41. The center axis of the cylinder and the center axis of the sample inlet 41 desirably coincide with each other.

Figure 4:
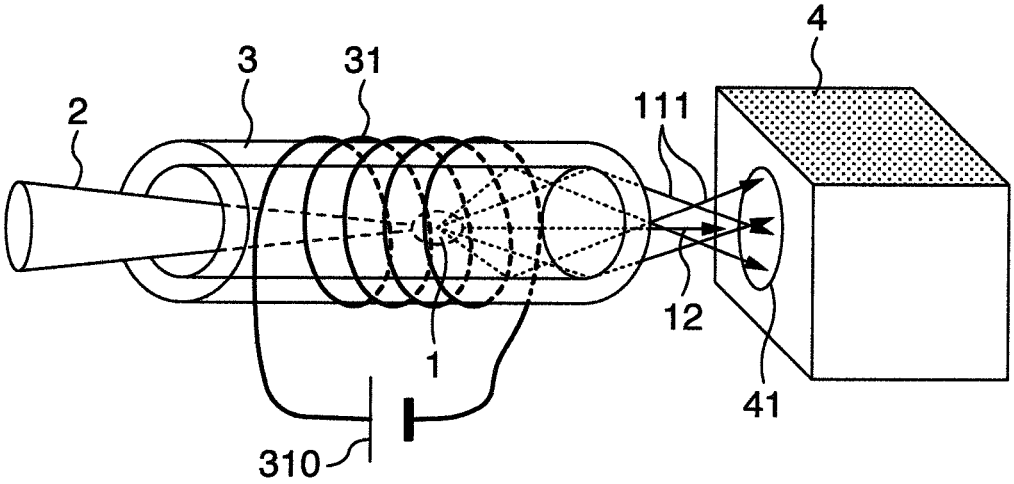
FIG. 4 is a diagram showing the cylindrical guide mechanism and a heating mechanism according to an embodiment of the invention.

Also, in order to quickly desorb the components adsorbed on the surface of the cylindrical guide mechanism 3, the cylindrical guide mechanism 3 is heated more advantageously to improve the spectrometry sensitivity. FIG. 4 shows an example in which an electric heating wire 31 such as a nichrome wire is wound on the cylindrical guide mechanism 3 to generate heat by use of the power from a heating power supply 310. The cylinder is thus heated desirably to about 100 to 300° C. The detention time $\tau$ of the molecules adsorbed on the wall surface of the cylindrical guide mechanism 3 is given as $$\tau=\tau o\exp(Ed/kT)$$

where τo is a constant, Ed the activation energy for desorption, k the Boltzmann constant and T the temperature.

Specifically, the smaller the activation energy for desorption, the longer the detention time for the molecules having a large activation energy for desorption, with the result that the quick desorption is hampered and the contribution to the spectrometry becomes more difficult. Therefore, the effect of heating the cylindrical guide mechanism is larger for the sample having a larger activation energy for desorption. Normally, a molecule having a larger molecular weight has a larger activation energy for desorption. Comparison between the molecules having the molecular weight of 100 and 200, for example, shows that at 300 K, the detention time of the molecules having the molecular weight of 100 is not longer than 1E-4s while the detention time of the molecules having the molecular weight of 200 is not shorter than 1E-6s. In spectrometry, the change in the signal amount per unit time is observed, and the spectrometry is actually impossible unless a signal is detected within 1 s from the detection of the first signal. In the spectrometry of the molecules having the molecular weight of 200, therefore, the cylindrical guide mechanism is less effective. At 500 K in temperature, on the other hand, the detention time is not longer than 1E-7s for the molecular weight of 100, and about 0.1 s for the molecular weight of 200. In this case, the molecules having the molecular weight of 200 can also sufficiently contribute to an improved spectrometry sensitivity.

The cylindrical guide mechanism 3 is heated separately from the sample heating probe 2. At the time of gasifying the sample, the sample heating probe 2 is quickly heated and gasified, after which the heating is stopped and the temperature is quickly decreased. In this way, the sample is intermittently gasified and sent to the ion source. As a result, both the sample heating probe 2 is heated and the current supplied intermittently. The cylindrical guide mechanism 3, in contrast, is not required to be heated intermittently, and may be heated using, for example, a continuous DC current or at a different timing from the sample heating probe 2.

Also, the surface temperature of the cylindrical heated guide mechanism 3 thus heated is desirably lower than the maximum temperature for the gasification process of the sample heating probe 2. If the temperature of the cylindrical guide mechanism 3 is too high, the sample 1 held in the sample heating probe 2 is increased to such a high temperature that the gasification of the sample would be adversely affected.

The material of the cylindrical guide mechanism 3, though not specifically limited, is desirably lower in activity such as molybdenum or the like metal which generates as little gas from the cylinder as possible. Other materials than the metal such as glass may of course be used as an alternative.

Figure 5:
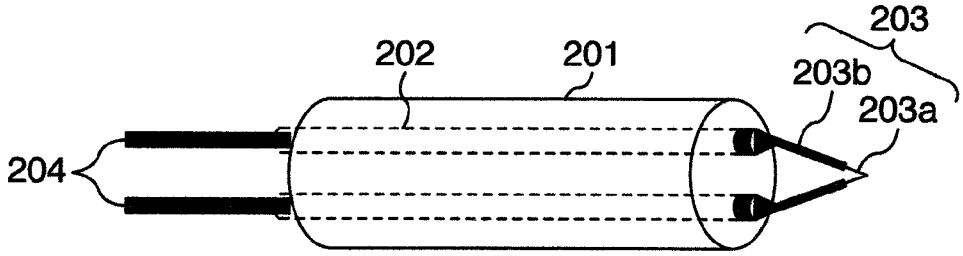
FIG. 5 is a diagram showing a sample heating probe of electric energization type according to an embodiment of the invention.

In FIGS. 2 to 4, the principle of the invention was explained on the assumption that the sample heating probe 2 has an ordinary shape of a needle. According to this embodiment, on the other hand, refers to a heating method which uses the joule heat generated at the time of supplying a current to a metal wire. FIG. 5 shows the sample heating probe of electric energization type. In FIG. 5, only the sample heating probe is shown, but not the cylindrical guide mechanism nor the ion source. Through a wiring 202 in a supporter of an insulating material, a metal wire 203 (including a thin wire portion 203*a* and a thick wire portion 203*b*) is mounted at the forward end of the sample heating probe. According to this embodiment, the wire of the portion on which the sample is mounted is formed still thinner to decrease the heating area as far as possible. A voltage is applied to an electrode 204 to energize the wire. By supplying a current of about several tens to 100 mA, the sample is heated to about 1000° C. and gasified within one second.

For convenience of explanation, the sample entrance chamber 20 and the ion optical system chamber 21 are shown separately from each other. Nevertheless, these chambers may alternatively be integrated without any problem.

Embodiment 2

Figure 6:
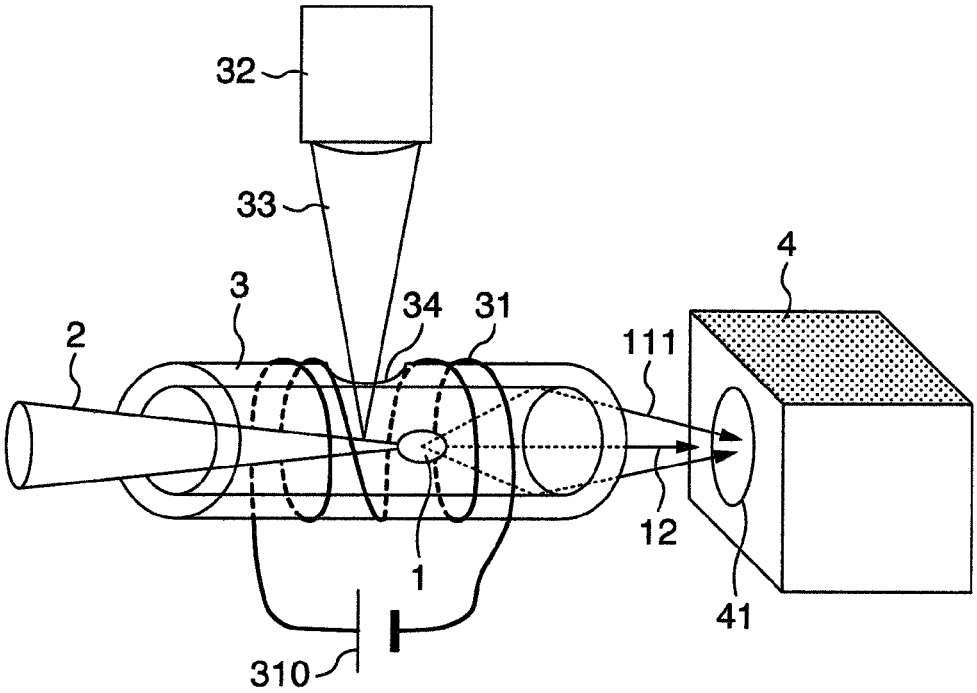
FIG. 6 is a diagram showing a sample heating probe of laser radiation type according to an embodiment of the invention.

Now, a case in which the laser heating is used as a heating mechanism is explained with reference to FIG. 6. The sample heating probe 2 of a metal with the sample 1 mounted at the forward end thereof is irradiated with the laser light 3 converged using a condenser 32 thereby to heat the sample 1. In FIG. 6, the laser light 33 converged by the condenser 32 is radiated not on the sample 1 but on the sample heating probe 2 in the vicinity of the sample 1. The reason is that if the sample 1 is irradiated directly, the organic high polymer compound would be changed to fragment ions with the bonding cut loose. Also, the manner in which the sample is desorbed and ionized directly by the laser light is still unknown in many points, and depends to a large measure on the state of the sample. It is very difficult, therefore, to obtain a steady spectrometry result in every session, and a different result may be obtained in a different measurement session. The converged laser light, therefore, is not radiated on the sample directly but on the sample heating probe in the vicinity of the sample. By doing so, the portion irradiated with the converged laser light provides a heat source. According to this embodiment, the material of the cylindrical guide mechanism 3 is quartz glass, and has an opening 34 for entrance of the laser light 33.

Figure 7:
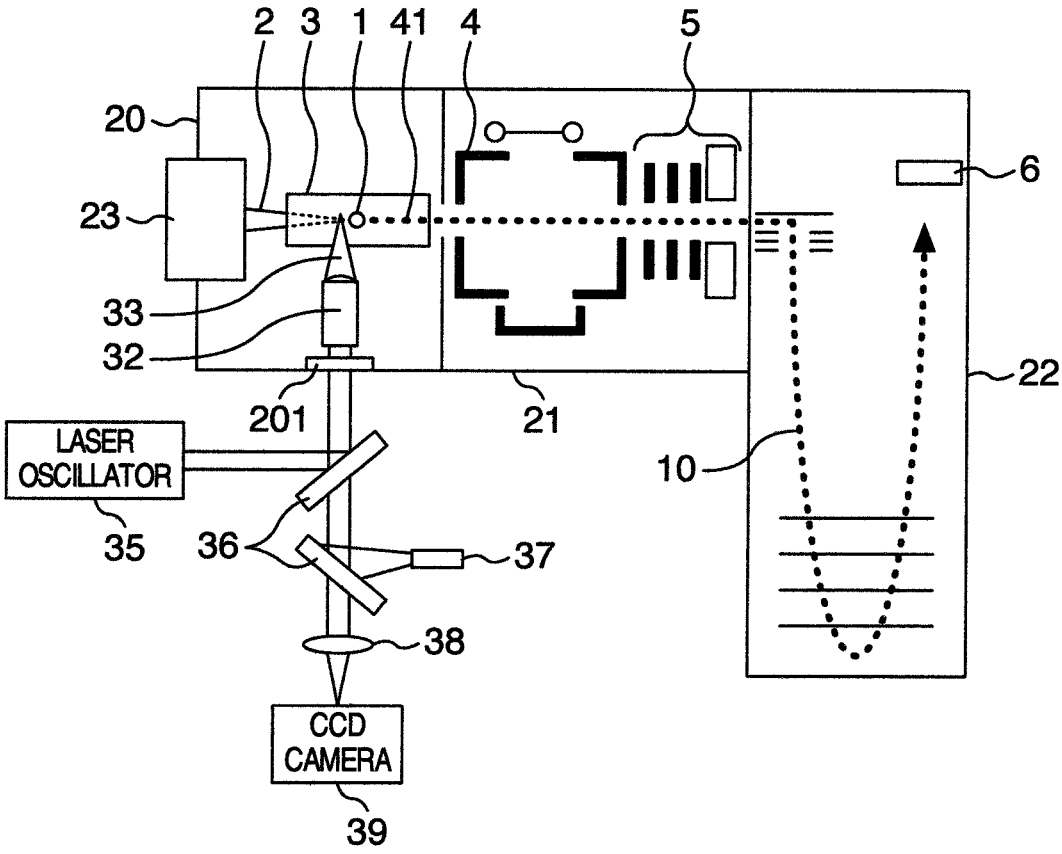
FIG. 7 is a diagram for explaining the configuration of the mass spectrometer using the laser radiation according to an embodiment of the invention.

FIG. 7 is a diagram showing the configuration of the mass spectrometer having a laser heating mechanism. The laser light emitted from a laser oscillator 35 is converged on the sample heating probe 2 through a beam splitter 36, a glass window 201 mounted on the spectrometer housing and the condenser 32. The mass spectrometer further includes an illumination light source 37, a focus lens 38 and a CCD camera 39 to facilitate the positioning of the laser spot and the sample heating probe 2 with respect to each other. Also, the spectrometer has such a structure that the relative positions of the cylindrical guide mechanism 3 and the sample heating probe 2 can be checked easily from a view port (not shown) mounted on the spectrometer housing. The laser light having the wavelength of 532 nm and the output of 1 W is generated continuously, and the spot diameter is reduced to about 1 to 3 μm by the condenser 32. This laser light is radiated for about 0.5 to several seconds. Also, the laser light is radiated on the part of the sample heating probe 2 about 10 μm distant from the sample mounted at the forward end of the sample heating probe.

According to this embodiment, the laser light is radiated not directly on the sample, but on the sample heating probe. Depending on the sample, however, the laser light may alternatively be radiated directly on the sample.

Embodiment 3

Figure 8:
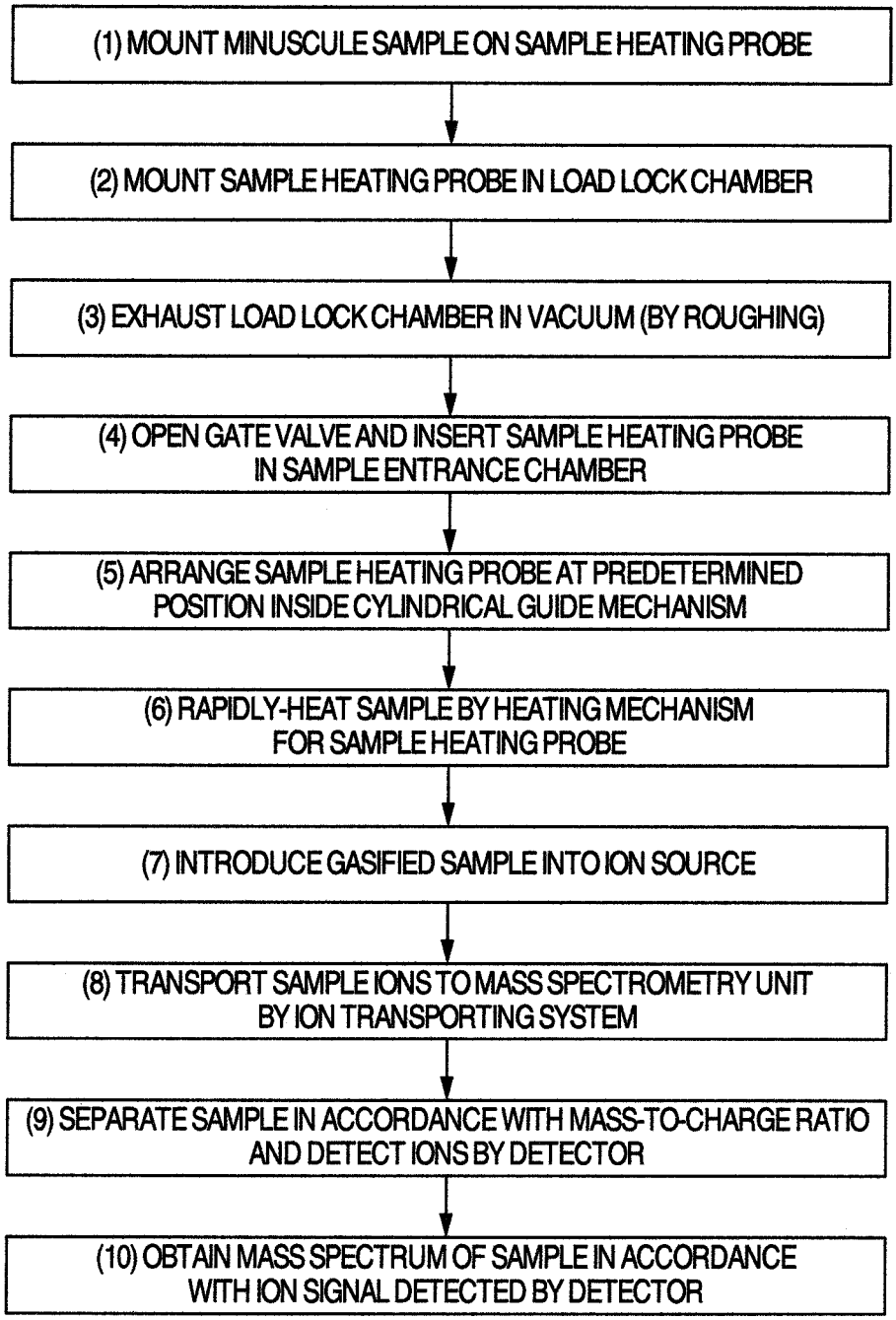
FIG. 8 is a flowchart for explaining the steps of the spectrometry method according to an embodiment of the invention.

Now, the steps of the actual spectrometry process are explained. The flow of the spectrometry process is shown in FIG. 8.

(1) First, a minuscule sample is mounted on the sample heating probe 2. This operation can be performed using a manipulator or the like with a commercially available microscope or the like attached thereto. In the case where the sample heating probe with the metal wire described in the first embodiment is used in the process, the foreign matter is retrieved by a needle-like metal probe having a sharp tip, after which the sample is transferred to the wire portion of the sample heating probe. In the case where the sample heating probe of a metal having a sharp forward end described in the second embodiment is used, on the other hand, the sample can be picked up directly at the forward end of the sample heating probe.

(2) Next, the sample heating probe with the foreign matter mounted thereon is loaded in the load lock chamber of the spectrometer according to the invention. In the process, the load lock chamber is opened to the atmosphere, while the other components including the sample entrance chamber, the ion optical system chamber and the mass spectrometry unit are kept in vacuum.

(3) The load lock chamber is exhausted in vacuum (by roughing) to about not more than 1 Pa. In the process, an oil-free scroll pump is used for vacuumization. Although the rotary pump may be used for roughing, the oil-free pump is more desirable, in case the pump oil is gasified and adversely affects the spectrometry.

(4) The gate valve arranged between the load lock chamber and the sample entrance chamber 20 is opened, and the sample heating probe 2 is inserted in the sample entrance chamber 20.

(5) The sample heating probe 2 is arranged at a predetermined position inside the cylindrical guide mechanism 3 in the sample entrance chamber 20. In the process, the sample heating probe 2 is desirably arranged at the center of the cylinder axis as far as possible.

(6) The sample heating probe 2 is heated so that the sample is heated and gasified. If the temperature is increased at an excessively low rate, the sample may be altered or the side reaction may occur during the heating process, thereby causing the loss of the original information of the sample. Therefore, the temperature should be increased as quickly as possible, or desirably, up to 600° C. or higher within one second. Incidentally, as described in the first embodiment, the cylindrical guide mechanism 3 should be heated to about 200 to 300° C. in advance.

(7) The part of the gasified sample that is introduced into the ion source directly or after bombarding the cylindrical guide mechanism 3 is ionized by the ion source.

(8) The sample ions are transported to the mass spectrometry unit through the ion optical system.

(9) The sample is separated in accordance with the mass-to-charge ratio by the mass spectrometry unit.

(10) Finally, the mass spectrum is obtained in accordance with the signal detected by the detector.

The steps (7) to (10) described above are similar to those for the ordinary mass spectrometer.

In FIG. 1, the ion source of electron impact type is used as an ion source, and the mass spectrometer of TOF (Time of Flight) type as a mass spectrometry unit. Nevertheless, the ion source and the mass spectrometry unit of other types may of course be used with equal effect. A still another alternative is the tandem mass spectrometer widely available on the market.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A mass spectrometer comprising:

a sample holding member for holding a sample;

a first heating means for heating the sample holding member in the shape of a needle and gasifying the sample not by radiating laser light on the sample directly;

an ion source for ionizing the gasified sample;

an ion transport optical system for transporting the ionized sample; and a mass spectrometry unit for detecting by separating, in accordance with the mass-to-charge ratio, the sample ionized and transported;

wherein the mass spectrometer further comprises a gasified sample guide means for leading the gasified sample to the ion source, and further comprises a second heating means for heating the gasified sample guide means in addition to the first heating means.

2. The mass spectrometer according to claim 1, wherein the gasified sample guide means is arranged around the sample held by the holding member and has a first opening in the direction toward the ion source.

3. The mass spectrometer according to claim 2, wherein the gasified sample guide means is cylindrical.

4. The mass spectrometer according to claim 1, wherein the first heating means for heating the sample and the second heating means for heating the gasified sample guide means are heated at different timings.

5. The mass spectrometer according to claim 1, wherein the temperature of the gasified sample guide means in heating operation is lower than the maximum temperature of the sample holding means.

6. The mass spectrometer according to claim 1, wherein the first heating means includes a metal wire, and the sample is heated using the joule heat generated by supplying an electric current to the metal wire.

7. The mass spectrometer according to claim 1, wherein the gasified sample guide means includes a second opening, and the sample is heated by the light entering from the second opening.

8. The mass spectrometer according to claim 7, wherein the light for heating the sample is a laser light.

9. The mass spectrometer according to claim 7, wherein the second opening is arranged on the other side of the sample far from the ion source.

10. A mass spectrometry method comprising the steps of:

heating and gasifying a sample held by a holding member in the shape of a needle not by radiating laser light on the sample directly;

ionizing the gasified sample by an ion source;

transporting the ions thus generated; and detecting by separating the transported ions in accordance with the mass-to-charge ratio;

wherein the sample is gasified with the holding member surrounded by the gasified sample guide means having a first opening directed toward the ion source, and the sample is gasified with heating the gasified sample guide means.

11. The mass spectrometry method according to claim 10, further comprising the step of:

heating and gasifying the sample with the gasified sample guide means heated.

* * * * *